United States Patent [19]

Griffiths et al.

[11] Patent Number: 4,872,859

[45] Date of Patent: Oct. 10, 1989

[54] LIFT AND LATCH APPARATUS FOR AN OUTBOARD MOTOR

[75] Inventors: John M. Griffiths, Fond du Lac; Lyle M. Forsgren, Oshkosh; Neil A. Newman, Omro; Wayne T. Beck, Fond du Lac, all of Wis.

[73] Assignee: Brunswick Corporation, Skokie, Ill.

[21] Appl. No.: 193,114

[22] Filed: May 11, 1988

[51] Int. Cl.[4] ..... B63H 21/26

[52] U.S. Cl. ..... 440/53; 248/640; 440/55

[58] Field of Search ..... 440/53, 61, 900, 55; 248/640, 643

[56] References Cited

U.S. PATENT DOCUMENTS 3,003,724 10/1961 Kiekhaefer ..... 440/61

4,013,249 3/1977 Meyer et al. ..... 440/61

*Primary Examiner*—Joseph F. Peters, Jr

*Assistant Examiner*—Edwin L. Swinehart

*Attorney, Agent, or Firm*—Andrus, Sceales, Starke & Sawall

[57] ABSTRACT

A transom extension assembly, particularly useful for smaller or auxiliary outboard motors, utilizes a pivotally connected 4-leg linkage and an operatively connected fluid power operator to lift the motor vertically with respect to the boat transom. The fluid power lift includes a mechanical latching apparatus by which the motor may be releasably held in its raised position and supported in its lowered position in a manner to relieve the hydraulic system from all other operating loads. The apparatus may include its own fluid pressure supply or may utilize fluid pressure from another boat system.

11 Claims, 2 Drawing Sheets

LIFT AND LATCH APPARATUS FOR AN OUTBOARD MOTOR

BACKGROUND OF THE INVENTION

The present invention relates to an apparatus for raising or lowering an outboard motor relative to the boat transom and, more particularly, to an improved power lift and latch apparatus for releasably holding the motor in its raised position and supporting the motor in its lowered position.

Marine propulsion devices, such as outboard motors, are supported from the boat transom by a mounting assembly. Outboard motors typically utilize a transom bracket for mounting the motor directly on the boat transom. Outboard motors mounted directly on the transom may usually be trimmed, either manually or with powered means, by pivoting the motor about a generally horizontal axis to position the propeller and optimize thrust with respect to the plane of the boat. However, the vertical position of the motor with respect to the boat cannot typically be changed beyond the somewhat limited amount which results from the trimming operation.

Another type of drive mounting assembly is one which is capable of selectively supporting an outboard motor in either a raised or a lowered position spaced aft of the boat transom. Many of these transom extension types of mounting assemblies are of the general type which include a pivotally connected quadrilateral linkage. Recently, transom extension mounting assemblies have become increasingly popular on high performance boats powered by outboard motors where a lower position of the motor improves initial boat acceleration and a higher position enhances top speed by reducing gear case drag. Additionally, a higher motor position reduces draft, thereby enhancing shallow water operation. It is further known that spacing the motor aft of the transom improves the handling characteristics of most boats at high speeds. These devices also allow the boat to have a higher transom for improved safety in following wave conditions and they also allow boat builders to manufacture a common hull and transom design for boat outboard and stern drive applications.

Examples of transom extension mounting assemblies for outboard motors which support the motor spaced from the transom are disclosed in the following U.S. Pat. Nos.: 2,782,744; 3,567,164; 3,990,660; 4,013,249; 4,168,818; 4,673,358; and 4,682,961. The first five of the foregoing patents disclose apparatus which is utilized to raise the motor vertically and the latter two patents describe apparatus which is utilized to trim the propeller and tilt the motor up and out of the water about a generally horizontal axis. More particularly, U.S. Pat. No. 3,567,164 discloses a pivotal quadrilateral linkage by which an auxiliary outboard motor is attached in a spaced relationship to the rear of a larger outboard motor used as a primary source of driving power. A mechanical lever arm is used to raise or lower the auxiliary outboard with respect to the main outboard motor and its selected vertical position is held by manually inserting a pin through aligned holes in a latch plate and one of the legs of the linkage. U.S. Pat. No. 4,013,249 describes an outboard motor mounting assembly including a four leg quadrilateral linkage to which is operatively attached a pressurized fluid cylinder to assist in the manual raising or lowering of the motor with respect to the transom. The assembly also includes a spring biased over-center mechanism which urges a slotted latching arm into engagement with a stud or pin on one of the legs of the linkage to hold the motor in either its raised or lowered position. U.S. Pat. No. 4,168,818 also describes a manually operated quadrilateral linkage for mounting an outboard motor spaced from the transom of the boat including a spring-biased latching arm having a slot within which travels a leg-mounted abutment pin to establish and hold the motor in its raised and lowered positions. Torsion springs are also used at the pivotal connections of the legs of the linkage to provide an assist to the manual lifting or lowering of the motor.

U.S. patent applications Ser. No. 092,168, filed Sept. 2, 1987 now U.S. Pat. No. 4,757,971, July 19, 1988; Ser. No. 100,216, filed Sept. 23, 1987 now U.S. Pat. No. 4,836,811, June 6, 1989; and Ser. No. 103,508, filed Oct. 1, 1987, now U.S. Pat. No. 4,836,124, June 6, 1989, all of which are assigned to the assignee of this application, disclose outboard motor transom extension mounting assemblies which utilize a quadrilateral linkage arrangement to raise and lower the motor with respect to the transom. The quadrilateral linkage comprises four pivotally connected links forming a collapsible linkage the movement of which effects vertical movement of the motor. Power to operate the linkage is preferably provided by a double acting hydraulic cylinder which operatively interconnects two of the links of the quadrilateral linkage to raise or lower the motor by extension or retraction of the cylinder. Of the foregoing pending U.S. application Ser. No. 103,508 discloses a quadrilateral transom mounting assembly with opposite arms of unequal length, the effect of which is to provide limited movement of the motor (i.e. rotation about a horizontal axis) simultaneously with the vertical lifting movement.

Powered transom extension mounting assemblies of the type described above are used principally with large outboard motors comprising the primary source of driving power. Transom extension mounting assemblies, particularly those utilizing a quadrilateral linkage, for small or auxiliary outboard motors are generally manually operated by the boat operator, sometimes with a spring or gas pressure lift assist. The mechanical latching apparatus utilized with such manually operated mechanisms has typically been complex and/or cumbersome to operate. In addition, the fully powered lift systems utilized with large outboard motors are too expensive and sophisticated to justify their use on smaller outboard motors where vertical operating position is generally not particularly important.

Nevertheless, it would be desirable to have a transom extension mounting assembly for smaller outboard motors which includes a power lift apparatus which is inexpensive and simple to operate. Certain operating conditions, such as shallow water operation or the presence of a shallow water obstacle, which may require the lifting of a large primary outboard motor, may also require the lifting of a small auxiliary motor. A small or auxiliary outboard motor may also have to be lifted for trailering, storage or while operating the primary engine. Such an auxiliary lift system should also have the capability of holding or maintaining the motor in its raised or lowered position without maintaining the fluid pressure in the power lift system.

SUMMARY OF THE INVENTION

The present invention provides a power lift system and latch apparatus, adapted for use with an outboard motor mounted on a transom extension assembly, for raising and lowering and releasably holding the motor in its raised position and supporting the motor in its lowered position.

In its preferred embodiment, the transom extension assembly, comprising a collapsible 4-leg linkage including a fluid pressure operated cylinder for operating the linkage to lift the motor in a vertical direction, has a latch bar which is pivotally attached to one of the legs of the linkage. The latch bar includes a slot defining first and second abutment surfaces. Another leg of the linkage includes stop means which extends into the slot in the latch bar and is movable in the slot in response to movement of the linkage and engageable with the abutment surfaces to hold the motor in its raised position and support the motor in its lowered position, respectively.

The assembly is operable to cause the stop means to engage the first abutment surface as a result of the extension of the fluid cylinder means, rotation of the latch bar about its pivotal connection in one direction, and subsequent release of the fluid pressure. The stop means holding the motor in its raised position is disengageable from the first abutment surface in the latch bar slot by an initial extension of the fluid cylinder means to remove the weight of the motor from the latch bar, and rotation of the latch bar in the other direction. The latch bar is preferably manually rotatable in said one direction and rotatable by gravity in the other direction. When the fluid cylinder means is retracted to cause the outboard motor to be vertically lowered, the stop means engages the second abutment surface to support the motor in its lowered position.

The fluid pressure operated cylinder means may comprise a single-acting hydraulic cylinder the extension of which operates to collapse the linkage and lift the motor. Fluid pressure is supplied to the hydraulic cylinder by a motor/pump and reservoir assembly which may be attached directly to the transom extension linkage. The fluid conduit operatively connecting the pump and the cylinder preferably includes pressure relief means to release the fluid pressure in the cylinder, either to effect engagement between the stop means and the first abutment surface for holding the motor in its raised position or to cause retraction of the cylinder and engagement of the stop means and second abutment surface to support the motor in its lowered position. The fluid pressure system from another hydraulically operated boat system, such as the trim, tilt or lift system for the primary marine drive, may alternatively be used to supply fluid power for the system of the present invention.

DETAILED DESCRIPTION OF THE PREFERRED EMBODIMENT

Figure 1:
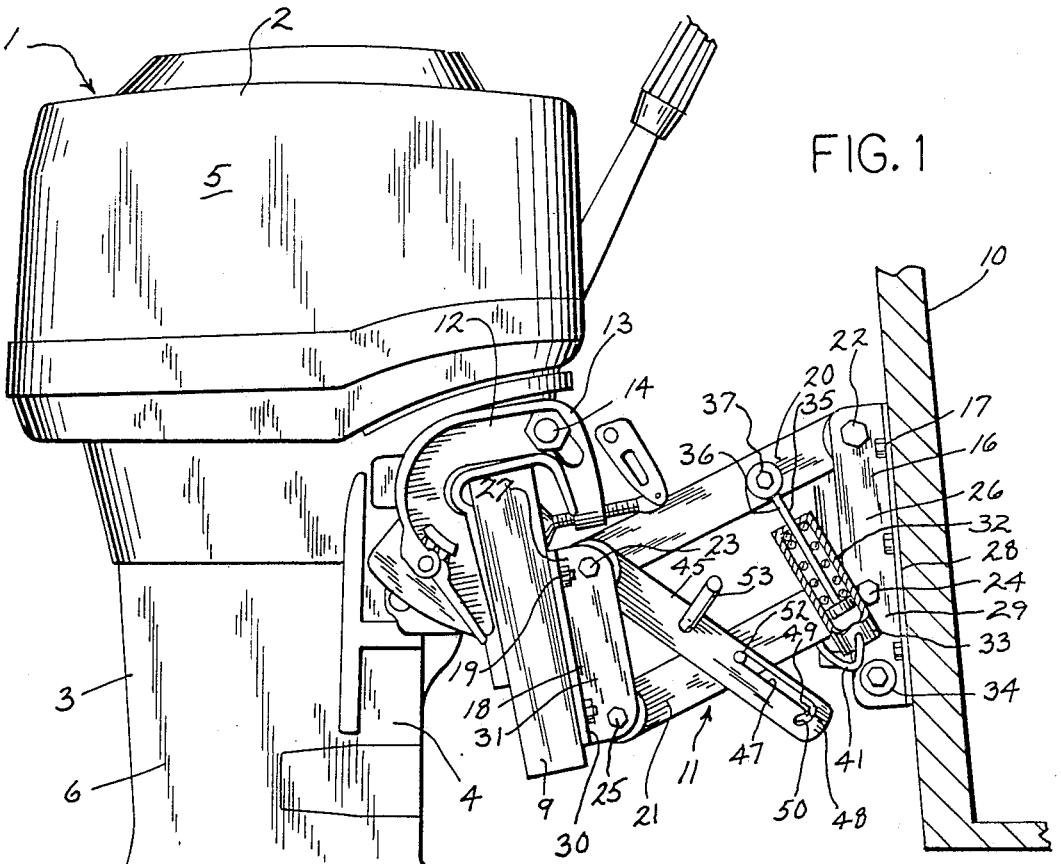
FIG. 1 is a side elevation view of an outboard motor, a transom extension assembly, and portions of the power lift and latching apparatus of the present invention, with the motor shown in its lowered position.

Referring to the drawing, a marine propulsion device comprises an outboard motor 1 including an upper unit or powerhead 2, a lower unit 3, and a swivel bracket 4. The powerhead 2 includes a cover of cowel 5 providing a housing for a water cooled internal combustion engine (not shown).

The lower unit 3 is rigidly attached to the bottom of the powerhead 2 and includes a driveshaft housing 6 and a gear case 7. The gear case 7 is submerged during operation of the outboard motor 1 and supports the propeller shaft to which is mounted a drive propeller 8. The gear case 7 also houses a transmission assembly which connects the propeller shaft to a driveshaft extending through the driveshaft housing 6 and operatively connected at its upper end to the engine.

The lower unit 3 is connected to the swivel bracket 4 for pivotal turning movement about a substantially vertical axis to provide steering control for the outboard motor 1 in a conventional manner. The outboard motor is supported spaced from the transom 10 of the boat by a transom extension assembly 11 and a transom bracket 12 to which the swivel bracket 4 is attached. The aft end of the transom extension assembly 11 includes a mounting plate 9 to which the outboard motor 1 is attached. The mounting plate 9 may comprise a piece of marine plywood or other suitable material. The motor is attached by the transom bracket 12 to the mounting plate on the transom extension assembly 11 for pivotal tilting movement about a horizontal axis and in a vertical plane between an operating position in which the gear case 7 and propeller 8 are fully submerged and an upwardly tilted position in which the gear case 7 and propeller 8 are raised out of the water, as for trailering or storage.

The transom bracket 12 includes a pair of spaced clamping members 13 (only one of which is shown) for demountably attaching the outboard motor to the mounting plate 9. Clamping members 13 are connected by a pivot pin 14 defining the horizontal axis about which the swivel bracket 4 and attached motor 1 pivot for tilting movement.

The transom extension assembly 11 comprises a four-leg quadrilateral linkage including a transom bracket leg 16 adapted to be attached to the transom 10 in a conventional manner, such as with mounting bolts 17, and a motor bracket leg 18 to which the mounting plate 9 is attached, as with mounting bolts 19. The transom extension assembly 11 further includes an upper leg 20 extending between the upper ends of the transom bracket and motor bracket legs 16 and 18, respectively, and a lower leg 21 extending between the lower ends of legs 16 and 18. One end of the upper leg 20 is pivotally connected at 22 to the upper end of the transom bracket leg 16, and the other end of upper leg 20 is pivotally connected at 23 to the upper end of the motor bracket leg 18. Similarly, the forward end of the lower leg 21 is pivotally connected at 24 to the lower end of the transom bracket leg 16, and the aft end of the lower leg 22 is pivotally connected at 25 to the lower end of the motor bracket leg 18.

Each of the legs comprising the transom bracket 16 and motor bracket 18 preferably comprises a pair of spaced angle members 26 and 27, respectively. Each of the angle members 26 is attached by one of its flanges 28 to the transom 10 with mounting bolts 17. The forward ends of the upper and lower legs 20 and 21, respectively, extend between the other flanges 29 of the angle members 26 and are attached thereto via the pivotal connections 22 and 24, respectively. Similarly, the pair of aft angle members 27 comprising the motor bracket leg 18 are each attached by one flange 30 to the mounting plate 9 with mounting bolts 19. The other flanges 31 of angle members 27 are spaced apart to receive therebetween the aft ends of the upper and lower legs 20 and 21 which are attached thereto via the pivotal connections 23 and 25, respectively. Each of the pivotal connections 22 through 25 may comprise a more or less conventional pivot pin which extends through the interconnected components, but the pins preferably include resilient bushings or other intermediate components that are effective in isolating motor vibrations and preventing them from being transmitted through the linkage to the boat. The upper and lower legs 20 and 21 each preferably comprise a solid bar of the same length.

The distance along the transom bracket leg 16 between pivotal connections 22 and 24 may be made less than the corresponding distance along the motor bracket leg 18 between pivotal connections 23 and 25. As a result, upper and lower legs 20 and 21 would not be parallel and the pivotal movement of their forward ends about pivotal connections 22 and 24 relative to the transom bracket leg would result in a tilting movement of the motor bracket leg 18 simultaneously with its generally vertical movement, as described in more detail in the above identified copending application Ser. No. 103,508. The resulting tilting movement would be upward as the motor is being lifted vertically and may be compared to a conventional trimming movement of an outboard motor.

Figure 2:
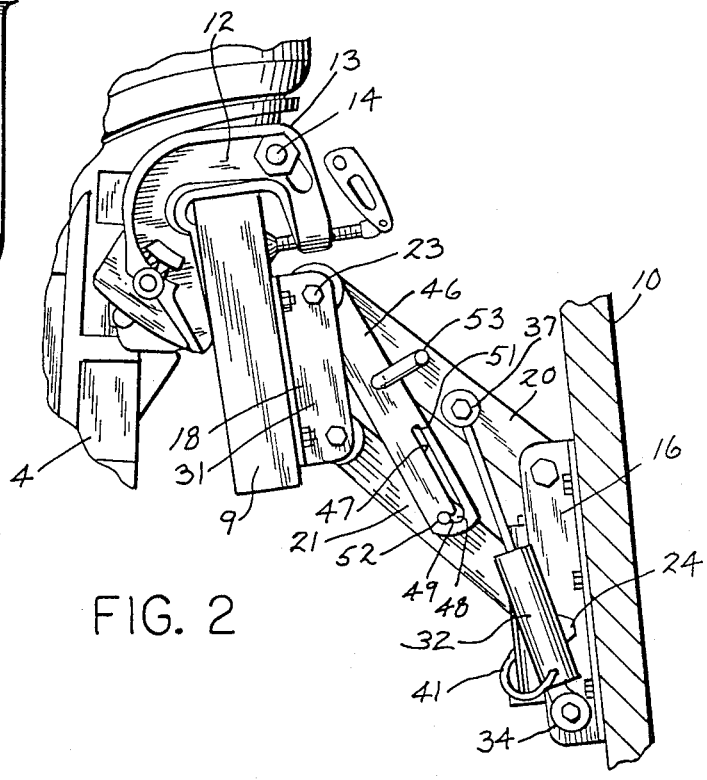
FIG. 2 is a side elevation view similar to FIG. 1, but showing the motor in its raised position.

To provide the force necessary to lift the outboard motor vertically, a hydraulic cylinder 32 is operatively attached between two of the legs of the transom extension linkage 11. The cylinder 32 includes a fixed cylinder end 33 having a trunion 34 pivotally attached to the lower end of the transom bracket leg 16 and an extensible rod end 35 including a conventional piston rod 36 with a piston slidably disposed in the cylinder and a free end including a trunion 37 pivotally attached to the upper leg 20 between its ends. With the rod end 35 of the cylinder 32 fully retracted, the pivotally connected linkage is in its more or less open position and the motor 1 is in its lowered position with respect to the transom 10, as shown in FIG. 1. When fluid pressure is supplied to the cylinder end 33 of the cylinder 32, the rod end 35 is extended causing the linkage to collapse and the motor to move vertically upward with respect to the transom until the rod end is fully extended and the motor is in its uppermost position, as shown in FIG. 2. The hydraulic cylinder 32 is preferably of the single-acting type in which fluid pressure is applied only to extend the rod end 35. Retraction of the rod end is effected by releasing the fluid pressure and allowing the weight of the motor to rotate the linkage downwardly and the cylinder to retract. To assist the retraction of the piston rod 36, a return spring 54 may be disposed within the cylinder surrounding the piston rod and extending between the piston and the cylinder end cap.

The cylinder end 33 of the hydraulic cylinder 32 is attached to the extended lower end of the transom bracket leg 16 below the lower pivotal connection 24 of the linkage. By lowering the point of attachment, a longer cylinder, providing the required extension and lift, may be more readily accommodated.

Figure 3:
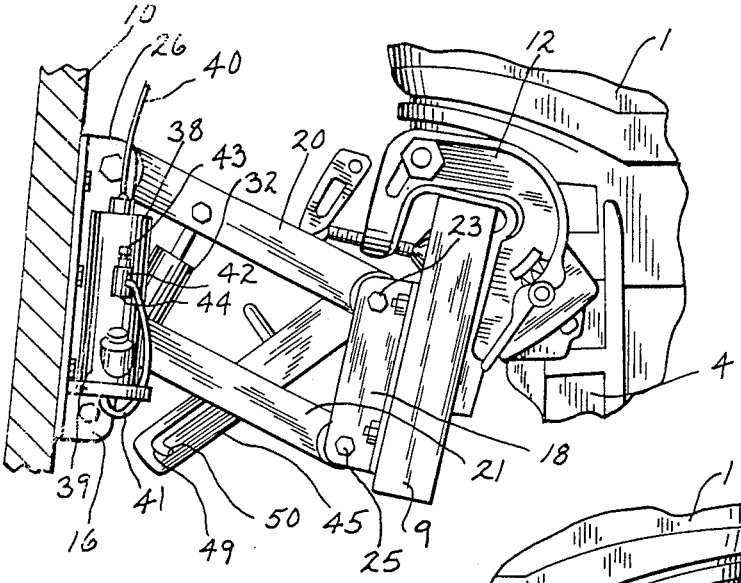
FIG. 3 is a side elevation view taken from the side opposite that shown in FIG. 1.

Fluid pressure is provided to the cylinder end of the cylinder 32 by a unitary fluid pressure supply apparatus 38 attached to the angle member 26 of the transom bracket leg 16 opposite the cylinder 32, as is best shown in FIG. 3. The fluid pressure supply apparatus 38 comprises a unitary motor-driven pump, reservoir and controls mounted within or attached to a common housing 39. Power to operate the electric motor to drive the hydraulic pump is supplied via an electrical connection 40 to an electrical power source and operator switch in the boat.

A fluid conduit 41 carries pressurized hydraulic fluid from the pump to the cylinder 32. A check valve between the pump outlet and the cylinder will maintain fluid pressure in the system and, at least temporarily, hold the cylinder in its extended position. To effect release of the fluid pressure for retraction of the cylinder and lowering of the motor, a pressure relief valve 42 is attached to the housing 39 and operatively interconnects the fluid conduit 41 and the reservoir within the housing 39. The pressure relief valve includes a manual release 43 operable from within the boat by reaching over the transom. The pressure relief valve may also include a solenoid activated release 44 which also may receive power from the electrical connection 40 and be operated from a switch within the boat. The solenoid actuated release 44 allows the apparatus to be unlatched and the motor lowered by operator control from the helm of the boat, in lieu of having to reach over the transom to use the manual release 43.

Although the fluid pressure used to extend the cylinder and lift the motor may be used to hold the motor in its raised or any intermediate position, as well as to hold the motor in its lowered position, it is preferable to have a positive mechanical stop to hold the lift mechanism in its raised and lowered positions. The utilization of fluid pressure to hold the positions may be unreliable due to fluid leakage past the cylinder piston and, in addition, the stress induced in the hydraulic system by external forces could result in a failure in the hydraulic system or in one of its component parts.

A latch bar 45 is operatively attached to the linkage comprising the transom extension assembly 11 to hold the motor in its raised position and to support the motor in its lowered position. The latch bar 45 includes an elongated body portion 46 which is pivotally attached at one end to one of the pivotal connections 21–25. In the embodiment shown in FIGS. 1 through 3, the latch bar is pivotally attached at the pivotal connection 23 between the motor bracket leg 18 and the upper leg 20. The other end of the latch bar 45 is provided with an elongated slot 47 which extends generally axially of the body portion 46. The portion of the slot 47 nearest the free end of the latch bar 45 includes a curved portion 48 which terminates in a notch 49 defining a downwardly facing first abutment surface 50. The upper opposite end of the slot 47 defines a downwardly facing second abutment surface 51. As shown, the latch bar 45 extends downwardly and forwardly from its pivotal connection 23 toward the transom 10. A pin 52 is attached to and extends laterally from the lower leg 21 and into the slot 47. The pin 52 is adapted to move within the slot in response to movement of the linkage between a position in engagement with the first abutment surface 50 when the motor is fully raised and a position in engagement with the second abutment surface 51 with the motor in its lowered position.

Referring particularly to FIG. 1, the slot 47 and pin 52 are located such that the pin comes into engagement with the second abutment surface 51 just before the rod end 35 of the cylinder 32 reaches its fully retracted position. This engagement provides a positive support for the motor which removes the load from the hydraulic system, such as may result from forward thrust of the operating motor and/or the weight of the motor. The weight of the motor alone can impose a substantial load in the system, either with the boat in the water or with the boat removed from the water and trailered with the motor in the down position.

When it is desired to lift the motor, the fluid pressure supply apparatus 38 is activated to extend the rod end 35 of the cylinder toward the position shown in FIG. 2. As the linkage collapses in response to extension of the piston rod, there is a relative downward movement of the pin 52 in the slot 47 toward the curved portion 48. As the rod end 35 of the cylinder 32 reaches its fully extended position, the pin 52 reaches the lower end of the slot 47. The latch bar 45 is then rotated upwardly about its pivotal connection 23, as by manual lifting of a handle 53 attached to the latch bar, to cause the pin 52 to move into the curved portion 48 of the slot 47, as shown in FIG. 2. The hydraulic pressure in the system is then released by activating the pressure relief valve 42, either via the manual release 43 or the solenoid-actuated release 44. Relief of the fluid pressure will result in engagement between the pin and the first abutment surface 50 to positively hold the motor in its raised position. The load imposed by the weight of the motor is thus removed from the hydraulic system and the motor may be held in its raised position without concern over a possible loss of fluid pressure.

To disengage the latch bar 45 from holding the motor in its raised position, fluid pressure is applied to cause extension of the cylinder. Slight extension of the cylinder will cause the pin to move out of the notch 49 defining the first abutment surface 50 and the latch bar will rotate downwardly under the force of gravity to move the pin 52 out of the curved portion 48 of the slot. Fluid pressure is then released by activating either the manual release 43 or the solenoid-activated release 44. Release of the fluid pressure to retract the rod end of the cylinder will result in relative upward movement of the pin in the slot toward the second abutment surface 51 as the motor moves vertically downwardly. Downward movement of the motor, upon release of the fluid pressure, may occur simply as a result of the weight of the motor. However, as previously described, the return spring 54 (FIG. 1) may be used to supplement the weight of the motor to assist in retraction of the cylinder rod and lowering of the motor.

As indicated above, the power lift and latch apparatus of the present invention is particularly adapted for use with smaller outboard motors, used to power smaller boats or as an auxiliary power source, such as for trolling, on larger boats. In either application, optimized performance is usually not an important consideration and, therefore, neither the primary lift function, nor the inherent tilting about the pivot pin 14 if legs of unequal length are used in the linkage, is normally utilized to optimize performance, e.g. for acceleration, power, or speed. As indicated, however, unequal lengths of the transom bracket and motor bracket legs 16 and 18, respectively would result in an inherent tilting or trimming of the motor as it is raised by the lift mechanism. For example, in a linkage having upper and lower legs 20 and 21 of equal length, say nine inches, if the transom bracket leg 16 has a length of four inches (between pivotal connections 22 and 24) and the motor bracket leg 18 has a length of six inches (between pivotal connections 23 and 25), movement of the outboard motor from the lower fully retracted to the upper fully extended position of the cylinder 32 will be accompanied by an outward trimming rotation of the motor about pivot pin 14 of approximately 24°. Although trimming may not be particularly valuable to optimize motor performance, the upward tilting rotation supplements the total lift provided by the system and results in a greater total lift for the lower unit 3 of the motor (including the gear case 7 and propeller 8). Of course, if the opposite pairs of legs of the linkage are of equal length, as shown, vertical movement of the motor will not be accompanied by any trimming or rotational movement about the pivot pin 14. The linkage of the present invention is preferably designed so that approximate optimized trim occurs in the full down position of the motor where it is most typically operated.

Figure 4:
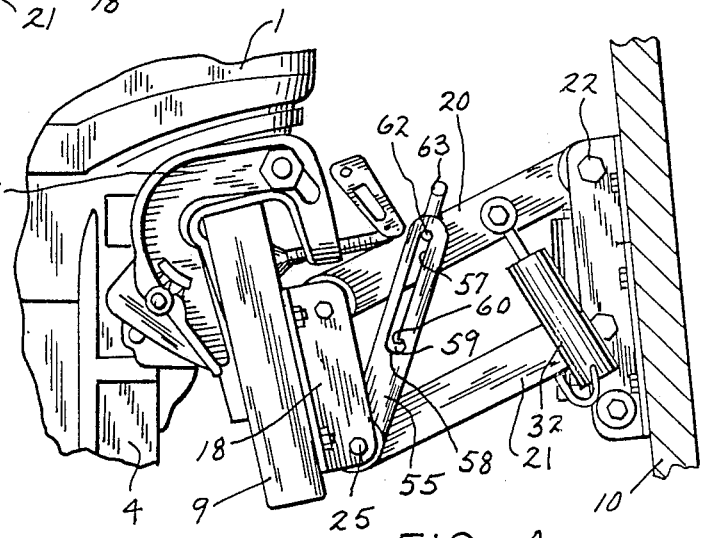
FIGS. 4 and 5 are side elevation views of a transom extension assembly similar to that shown in FIGS. 1 and 2, showing an alternate embodiment of the latch bar.
Figure 5:
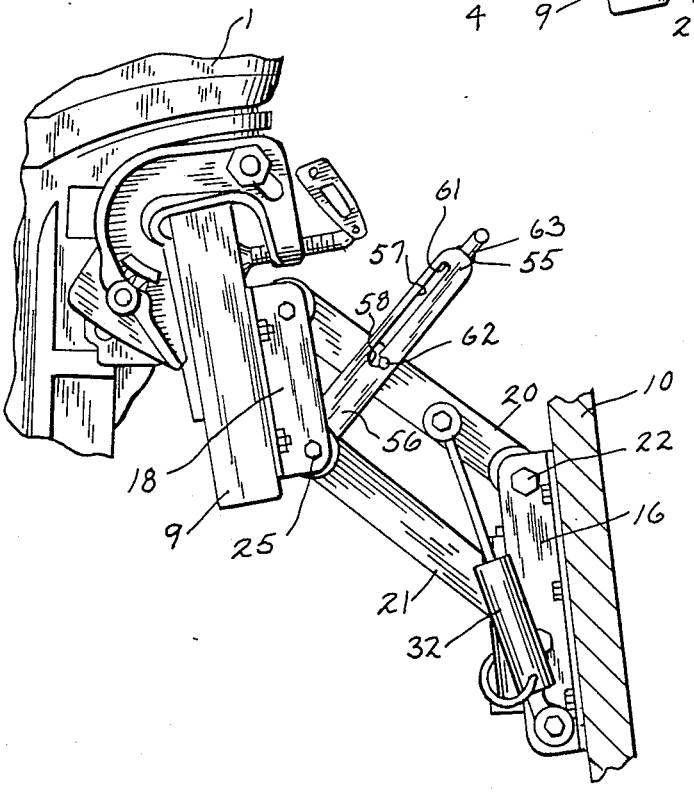

In FIGS. 4 and 5, there is shown a latch bar 55 of alternate construction and attachment utilized with a lift system which is otherwise identical to the preferred embodiment. The alternate latch bar 55 is attached for rotational movement about pivotal connection 25. The latch bar 55 includes a slot 57 which is identical to the slot 47 of the preferred embodiment, except for its inverted position with respect to the body portion 56 of the bar 55. Thus, the slot 57 includes a curved portion 58 in the end of the slot furthest from the free end of the bar 55. The curved portion 58 defines a notch 59 which terminates in a first abutment surface 60. The opposite end of the slot 57 terminates in a second abutment surface 61. A stop pin 62 is attached to the upper leg 20 and extends laterally into the slot 57 for relative movement therein in response to movement of the linkage, as previously described with respect to the preferred embodiment.

In the down position of the lift mechanism, as shown in FIG. 4, the pin 62 is in engagement with the second abutment surface 61 to support the motor in the down position. Extension of the cylinder and collapse of the linkage to raise the motor results in relative downward movement of the pin 62 in the slot 57 until it reaches the curved portion 58 at the point of full cylinder extension. The latch bar is then manually rotated upwardly and rearwardly of the transom, as by the operator grasping a handle 63 from within the boat, to cause the pin to move into the notch 59 defined by the curved portion 58. The latch bar 55 is held in this position while the fluid pressure is released, allowing the pin to engage the first abutment surface 60 to hold the motor in its raised position.

Either of the latch bars 45 or 55 of the preferred and alternate embodiments, respectively, may be attached to the linkage in a number of ways and still function in essentially the same manner. Thus, for example, the latch bar 45 may be attached to either side of the linkage, it could be pivotally attached at the pivotal connection 24, or it could have a separate pivotal connection on any one of the four legs 16, 18, 20 or 21. However, convenience in manufacture and assembly makes utilization of one of the pivotal connections 23 or 24 more desirable. Similarly, latch bar 55 could be mounted for rotation about pivotal connection 22 or utilize a separate pivotal connection on one of the four legs of the linkage. Also, the separate fluid pressure supply apparatus 38 could be eliminated and fluid pressure to operate the lift apparatus could be supplied by the hydraulic system used with the primary propulsion unit. Thus, the hydraulic system utilized to trim and/or lift a large outboard motor or to trim a stern drive unit could be used to provide fluid pressure for the lift apparatus of the present invention.

Various modes of carrying out the invention are contemplated as being within the scope of the following claims particularly pointing out and distinctly claiming the subject matter which is regarded as the invention.

I claim:

1. In a transom extension assembly for mounting an outboard motor to a boat to provide vertical movement of the motor relative to the transom between raised and lowered positions, said assembly having a collapsible four-leg linkage including a transom bracket leg attached to the transom, a motor bracket leg adapted to support the motor, and upper leg pivotally connected at its ends to the upper ends of the transom and motor bracket legs, and a lower leg pivotally connected at its ends to the lower ends of the transom and motor bracket legs, and fluid pressure operated cylinder means including a cylinder end and an extensible rod end operatively attached to said linkage such that extension of said rod end by fluid pressure effects controlled collapse of said linkage and lifting of the motor in a generally vertical direction, an improved power lift and latch apparatus for releasably holding the motor in its raised position and supporting the motor in its lowered position comprising:

a latch bar pivotally attached at one end to one of said legs for rotation in opposite directions;

said latch bar including manually operable control means for manually rotating the latch bar in one direction;

said latch bar being attached for rotation by gravity in the other direction;

a slot in said latch bar including first and second abutment surfaces at opposite ends of said slot;

stop means on another of said legs, said stop means extending into said slot and movable therein in response to movement of the linkage;

said stop means adapted to engage said first abutment surface to hold the motor in its raised position in response to extension of said rod end, manual rotation of said latch bar in one direction and release of the fluid pressure;

said stop means adapted to disengage said first abutment surface in response to extension of said rod end and rotation by gravity of said latch bar in the other direction; and said stop means adapted to engage said second abutment surface to support the motor in its lowered position in response to release of the fluid pressure and retraction of said rod end.

2. The apparatus of claim 1 wherein the cylinder means comprises a single-acting hydraulic cylinder.

3. The apparatus of claim 2 including means for supplying fluid pressure to said hydraulic cylinder, said supply means comprising:

a pump including a source of hydraulic fluid and an outlet conduit to said cylinder to provide fluid pressure for extension of said rod end; and, relief means connecting said conduit and said source of hydraulic fluid for releasing the fluid pressure.

4. The apparatus of claim 3 wherein said relief means comprises a manually operable pressure relief valve.

5. The apparatus of claim 3 wherein said relief means comprises an electrically actuated pressure relief valve.

6. The apparatus of claim 1 wherein said latch bar is pivotally attached at the pivotal connection between the motor bracket leg and the upper leg.

7. The apparatus of claim 6 wherein said stop means is attached to the lower leg.

8. In a transom extension assembly for mounting an outboard motor to a boat to provide vertical movement of the motor relative to the transom between raised and lowered positions, said assembly having a collapsible four-leg linkage including a transom bracket leg attached to the transom a motor bracket leg adapted to support the motor, an upper leg pivotally connected at its ends to the upper ends of the transom and motor bracket legs, and a lower leg pivotally connected at its ends to the lower ends of the transom and motor bracket legs, an apparatus for releasably holding the motor in its raised position and supporting the motor in its lower position comprising:

means for applying a lifting force to the linkage to raise the motor in a generally vertical direction;

a latch bar pivotally attached at one end to one of said legs for rotation in opposite directions;

a slot in said latch bar including first and second abutment surfaces at opposite ends of said slot;

stop means on another of said legs, said stop means extending into said slot and movable therein in response to vertical movement of the motor;

said stop means adapted to engage said first abutment surface to hold the motor in its raised position in response to lifting movement of the motor to its raised position, manual rotation of said latch bar in one direction and release of the lifting force;

said stop means adapted to disengage said first abutment surface in response to application of the lifting force and rotation by gravity of said latch bar in the other direction; and, said stop means adapted to engage said second abutment surface to support the motor in its lowered position in response to release of the lifting force.

9. The apparatus of claim 8 wherein the means for applying a lifting force comprises a fluid pressure operated cylinder operatively interconnecting two of the legs of the linkage.

10. The apparatus of claim 9 including means for supplying fluid pressure to said cylinder comprising:

a housing mounted on the transom bracket leg of the linkage, said housing defining a reservoir for hydraulic fluid;

a motor-driven hydraulic pump disposed in said housing;

fluid conduit means for carrying pressurized hydraulic fluid from the pump to the cylinder; and, pressure relief means connecting said fluid conduit means and said reservoir for selectively releasing the fluid pressure to the cylinder.

11. In a transom extension assembly for mounting an outboard motor to a boat to provide vertical movement of the motor relative to the transom between raised and lowered positions, said assembly having a collapsible four-leg linkage including a transom bracket leg attached to the transom, a motor bracket leg adapted to support the motor, an upper leg pivotally connected at its ends to the upper ends of the transom and motor bracket legs, and a lower leg pivotally connected at its ends to the lower ends of the transom and motor bracket legs, an improved power lift and latch apparatus for releasable holding the motor in its raised position and supporting the motor in its lower position comprising:

a hydraulic cylinder operatively interconnecting two of the legs of the linkage such that extension of the cylinder under the application of fluid pressure effects a lifting of the motor in a generally vertical direction;

a latch bar pivotally attached at one end to one of said legs for manual rotation in one direction and rotation by gravity in the other direction;

a slot in said latch bar including first and second abutment surfaces at opposite ends of said slot;

stop means on another of said legs, said stop means extending into said slot and movable therein in response to vertical movement of the motor;

said stop means adapted to engage said first abutment surface to hold the motor in its raised position in response to extension of said cylinder, rotation of said latch bar in said one direction and release of the fluid pressure;

said stop means adapted to disengage said first abutment surface in response to extension of said cylinder and rotation of said latch bar in the other direction; and, said stop means adapted to engage said second abutment surface to support the motor in its lowered position in response to release of the fluid pressure and retraction of said cylinder.

* * * * *